United States Patent [19]

Wu et al.

[11] 3,970,452

[45] July 20, 1976

[54] CHARGED PARTICLE MODULATOR DEVICE AND IMAGING METHODS

[75] Inventors: Alexander Chiang-Hsia Wu, Wayne, Mich.; Shou Ling Hou, Chagrin Falls, Ohio

[73] Assignee: Addressograph Multigraph Corporation, Cleveland, Ohio

[22] Filed: Aug. 30, 1974

[21] Appl. No.: 502,025

[52] U.S. Cl. ..... 96/1 R; 96/1 A

[51] Int. Cl.[2] ..... G03G 13/00; G03G 5/00

[58] Field of Search ..... 96/1 R; 355/3 R

[56] References Cited

UNITED STATES PATENTS

| | | | |
|---|---|---|---|
| 2,712,607 | 7/1955 | Orlando | 96/1 R |
| 3,615,395 | 10/1971 | Yamaji | 96/1 R |
| 3,625,604 | 12/1971 | Pressman | 355/3 |
| 3,645,614 | 2/1971 | McFarlane et al. | 355/3 |
| 3,666,365 | 5/1972 | Tanaka et al. | 355/17 |
| 3,730,709 | 5/1973 | Kinoshita et al. | 96/1 R |
| 3,881,921 | 5/1975 | Frank | 96/1 R |

*Primary Examiner*—David Klein
*Assistant Examiner*—L. Y. Falasco
*Attorney, Agent, or Firm*—Michael A. Kondzella

[57] ABSTRACT

An ion modulator of improved sensitivity and capable of producing copies of excellent quality is provided in the form of a conductive metal screen which is coated with an insulator and overcoated with a photoconductor. This modulator configuration is characterized by having memory capabilities, being capable of being operated in both the positive and negative modes and functioning without injection contact.

21 Claims, 7 Drawing Figures

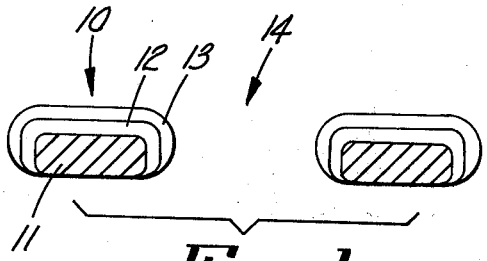
Fig. 1
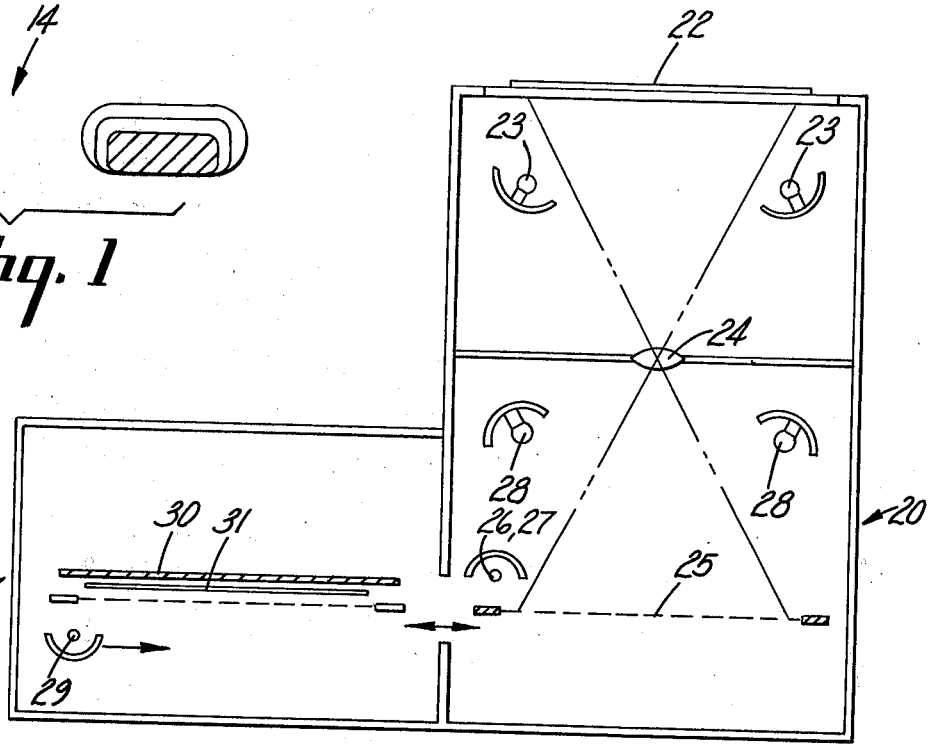
Fig. 2
Fig. 3
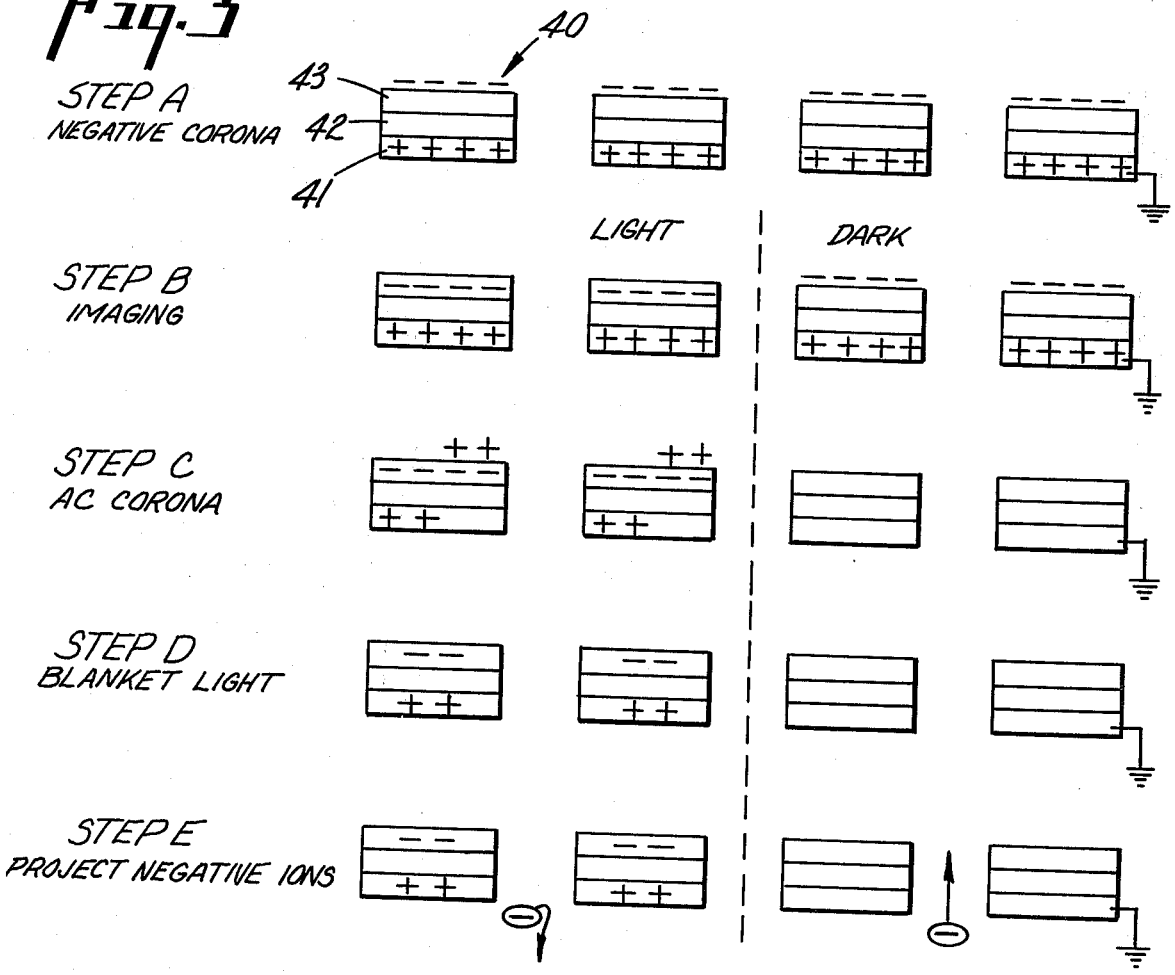

Fig. 6
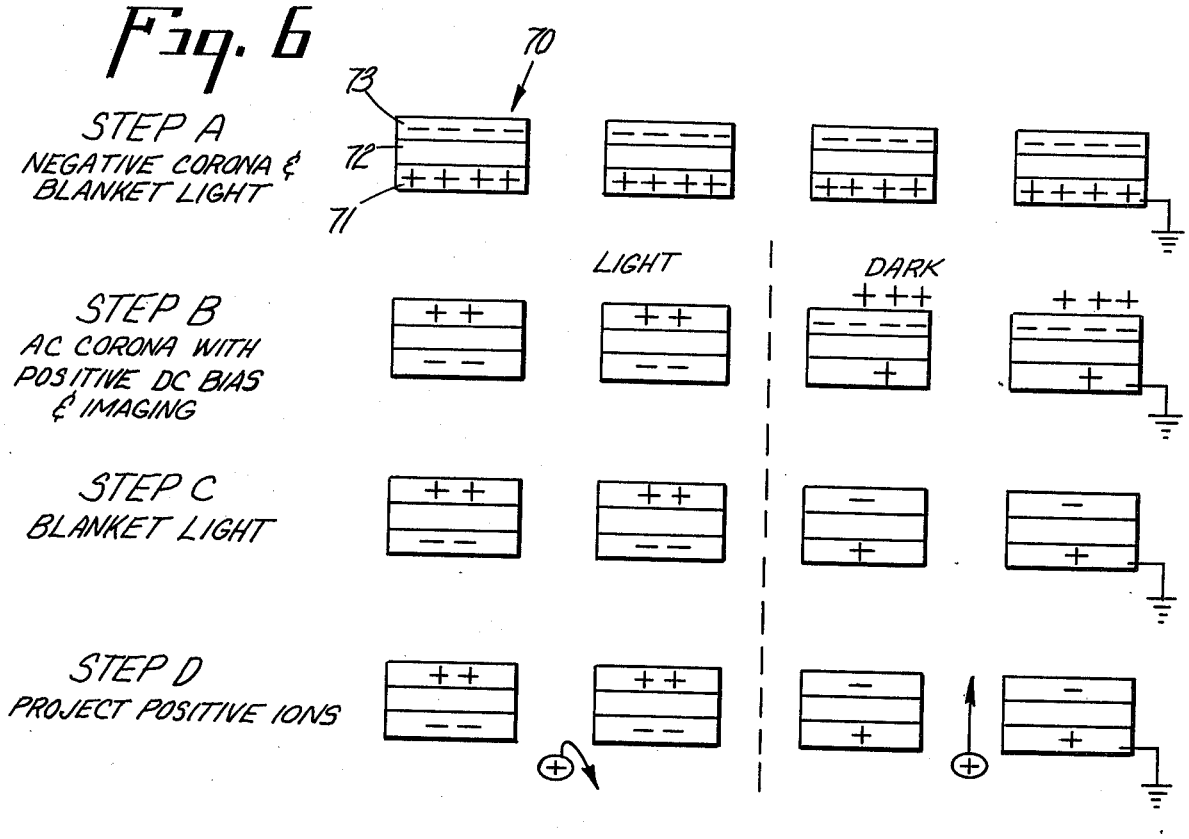
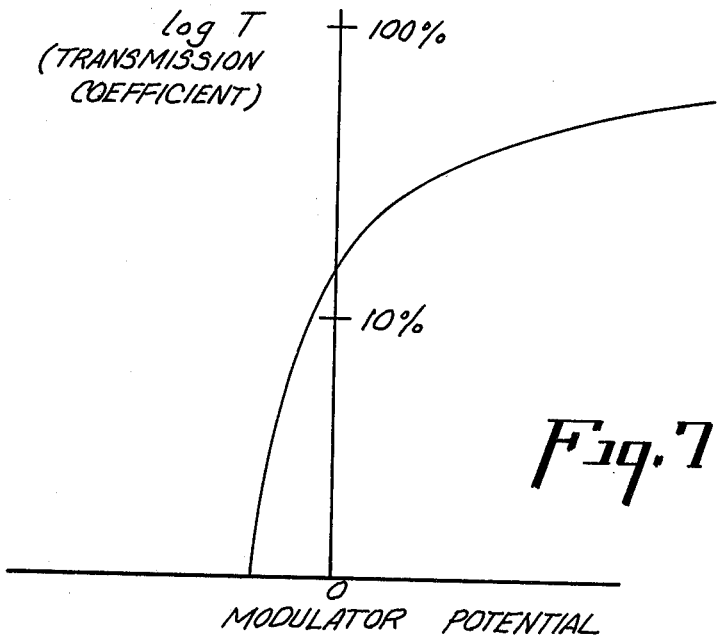
Fig. 7

CHARGED PARTICLE MODULATOR DEVICE AND IMAGING METHODS

BACKGROUND OF THE INVENTION

This invention relates to electrophotographic processes and apparatus. In one of its more particular aspects this invention relates to a versatile multi-layered ion modulator and its use in an electrophotographic process which is capable of operating in both the positive and negative modes.

Electrophotographic reproduction techniques for making copies of graphic originals using photoconductive media are well known. Such processes generally call for applying a blanket eletrostatic charge to a photoconductor in the dark and then exposing the charged photoconductor to a pattern of light and shadow created by directing electromagnetic radiation onto a graphic original. The light-struck areas of the photoconductor are discharged leaving behind a latent electrostatic image corresponding to the original. A developed image is produced by applying an electroscopic powder to the latent electrostatic image and then fixing the image or transferring and fixing onto a suitable receiving medium such as plain paper.

This technique has been extended to foraminated structrues which are formed by applying a photoconductive layer to a conductive screen or similar apertured structure. Such structures function as ion modululators selectively passing a stream of ions through the apertures of the screen in a pattern corresponding to the graphic original to be reproduced.

The ion modulators which have been developed heretofore and are known in the prior art fall into several distinct classes:

The first is a two-layered screen or grid construction which is formed by applying a photoconductive layer onto an apertured metallic substrate. Such a structure is capable of accepting an electrostatic charge corresponding to a pattern of light and shadow created by electromagnetic radiation directed onto a graphic original. The operation and construction of such a device requires that the projection of ions through the screen occur simultaneously with the projection of the pattern of light and shadow. The simultaneity requirement is occasioned by the inability of such a system to retain or have any long "memory" in terms of the charge pattern imparted to the structure.

A second group of photoconductive screens has been adapted for use with charged material particles such as charged electroscopic powders but not gas ions. Such structures suffer from the deficiency that charged particles accumulate in those areas of structure which attract the particles. Ultimately, it is required that the screen be cleaned to physically remove the particles in order that the screen may be reused.

A three layer modulator is disclosed in co-pending applications Ser. Nos. 423,883 and 423,884 filed Dec. 12, 1973, of John D. Blades and Jerome E. Jackson assigned to the same assignee as this application. The three layered modulator described in the above mentioned application possesses a memory which makes it unnecessary to simultaneously image and project ions through the modulator.

While the prior art modulators have advanced the electrophotographic art there are disadvantages which need to be overcome in order to provide an ion modulator system which is sufficiently versatile so that copies can be made in both the positive and negative modes. It is also desirable to provide copies which have a high degree of contrast between image and background areas.

OBJECTS

It is accordingly an object of this invention to provide improved electrophotographic apparatus and processes.

It is another object of this invention to provide improved ion modulators which are capable of functioning in both the positive and negative modes.

It is another object of this invention to provide ion modulators having memory capabilities.

Another object of this invention is to provide ion modulators which can function without injection contact.

Yet another object of this invention is to provide processes and apparatus for producing copies in which a high level of contrast is displayed between image and background areas.

Other objects and advantages of this invention will become apparent in the course in the following detailed disclosure and description.

SUMMARY OF THE INVENTION

It has been found that an ion modulator consisting of a conductive screen or grid coated with an insulator and overcoated with a photoconductor results in a versatile modulator which displays memory capabilities and can function in both positive and negative modes without injection contact.

The use of such an ion modulator in various electrophotographic processes results in the production of copies which display a high contrast level between image and background areas.

THE DRAWING

FIG. 1 is a diagrammatic cross-sectional view of a portion of an ion modulator according to this invention.

FIG. 2 is a diagrammatic view of a machine configuration suitable for use in this invention.

FIG. 3 is a diagrammatic view of the steps involved in one process for producing a latent electrostatic image using the ion modulator of this invention.

FIG. 6 is a diagrammatic view of another such process.

FIG. 7 is an ion transmission curve representative of the transmission of ions through the ion modulator of this invention.

DESCRIPTION OF THE PREFERRED EMBODIMENTS

Figure 4:
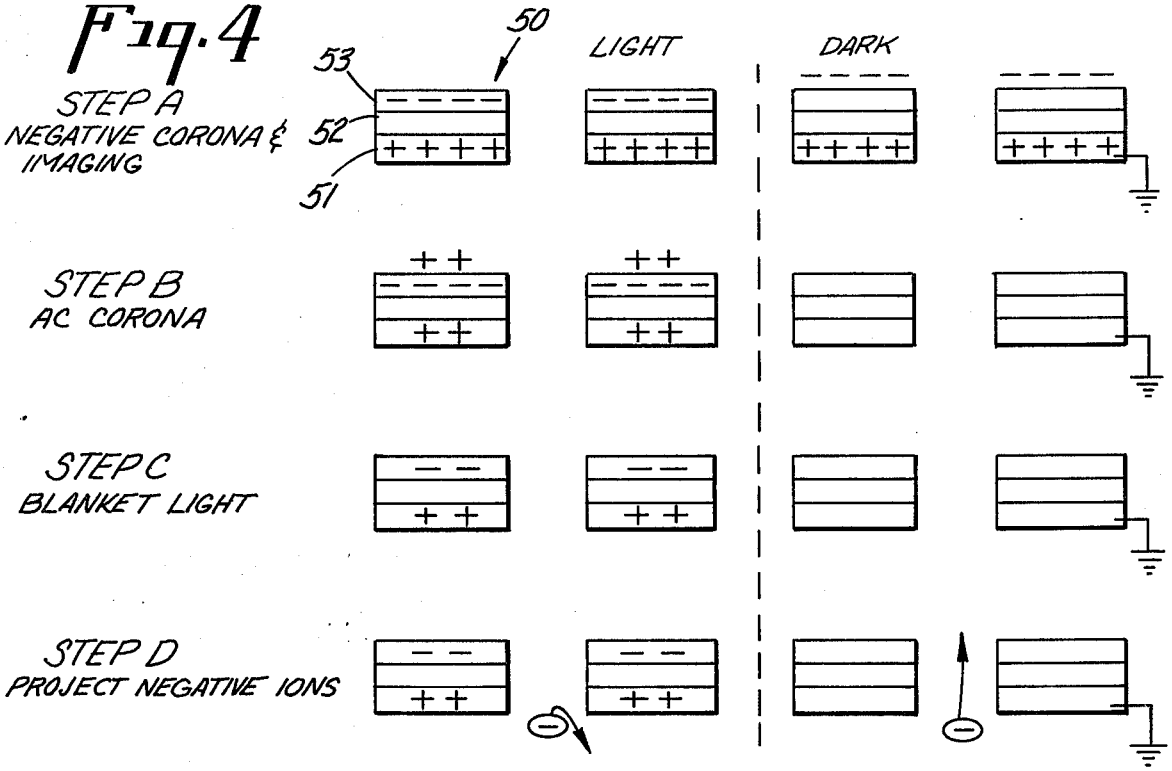
FIG. 4 is a diagrammatic view of another such process.

Referring to FIG. 1 there is shown in cross-section a diagrammatic view of an ion modulator according to this invention. The modulator 10 consists of conductor 11 to which is applied substantially only to one side thereof a coating of insulating material 12 which is overcoated with photoconductor 13. The apertures in the ion modulator are generally indicated by the numeral 14. Conductor 11 can be a stainless steel, nickel or copper screen which is produced by electroforming or can be any metallic grid which is produced by means of photoresist techniques or can be produced by any other conventional method of producing an apertured configuration in a metallic substrate. The metal is preferably less than about 1 mil in thickness.

Insulating material 12 can be any insulator. Any polymeric insulating composition such as polystyrene or a polyester can be used on the insulator can be prepared from silicon dioxide, silicon nitride, boron nitride, or other inorganic insulating material. The insulating layer is preferably on the order of from 2 to 10 microns in thickness and may be deposited upon conductor 11 by means of any suitable coating technique, such as by sputtering an inorganic insulating material upon the surface of the metallic substrate. The presence of an insulating layer between the conductor and the photoconductor prevents injection contact of charges into the photoconductor and results in enhanced contrast between image and background areas corresponding to areas of light and shadow in the original being copied.

Photoconductor 13 should exhibit properties of increased conduction in the presence of light. A wide variety of photoconductors are known including inorganic materials like selenium or zinc oxide and various organic photoconductors such as polyvinylcarbazole, the polyvinylbenzocarbazoles described in U.S. Pat. No. 3,751,246 to Helen C. Printy and Evan S. Baltazzi and polyvinyliodobenzocarbazoles described in U.S. Pat. No. 3,764,316 to Earl E. Dailey, Jerry Barton, Ralph L. Minnis and Evan S. Baltazzi. Other organic photoconductors which may be used include monomeric photoconductors which require dispersion in a resin binder. These photoconductors include the benzofluorenes and dibenzofluorenes described in U.S. Pat. No. 3,615,412 to William J. Hessel and the cumulenes described in U.S. Pat. No. 3,674,473 to Robert G. Blanchette all assigned to the same assignee as this invention. In many instances the organic photoconductors mentioned above may be used with a suitable sensitizer to extend the spectral range of the photoconductor. Dyes may be used for this purpose. Another class of materials which are widely used are the pi acids. Representative of these compounds are the oxazolone and butenolide derivatives of fluorenone described in U.S. Pat. No. 3,556,785 to Evan S. Baltazzi, the dicyanomethylene substituted fluorenes described in U.S. Pat. No. 3,752,668 to Evan S. Baltazzi, and the bianthrones described in U.S. Pat. No. 3,615,411 to William J. Hessel, all assigned to the same assignee as this invention.

A machine in which the ion modulator of this invention can be used is shown in FIG. 2. The machine generally consists of optical chamber 20 and projection chamber 21. Original 22 to be copied is imaged in optical chamber 20 by means of lamps 23 and lens 24 upon ion modulator 25 which can be charged by means of charging corona 26, subjected to an AC corona 27, or blanketed with light by means of floodlights 28 as required by the particular process being used.

Ion modulator 25 is then moved into projection chamber 21 where an ion stream from projection corona 29 is caused to impinge thereon.

In this position ion modulator 25 is backed up by high voltage plate 30. Dielectric surface 31 interposed between ion modulator 25 and high voltage plate 30 receives a charge pattern corresponding to the ions transmitted through ion modulator 25 as will be explained in detail below.

The operation of the ion modulator of this invention is illustrated in FIG. 3 which shows the steps involved in using the ion modulator of this invention in a positive mode to produce a positive copy from a positive original. Ion modulator 40 includes metallic screen 41, insulator 42, and photoconductor 43. Screen 41 is connected to ground potential.

The process steps which result in producing a latent electrostatic image upon a dielectric surface such as dielectric paper using the ion modulators of this invention include the following. Step A: precharging in the dark with a negative corona. Step B: imaging to obtain light discharge. Step C: applying an AC corona in the dark to discharge the dark areas of the ion modulator and to redistribute the positive charges between the outside surface of the photoconductor and the interface between the insulator and the metallic screen. Step D: applying a blanket or flooding light to discharge the photoconductor resulting in the production of a dipole potential across the insulator in the light areas of the modulator. Step E: projecting a negative corona from the screen side of the modulator. Following the production of a latent electrostatic image, toning and transfer if desired is accomplished in the conventional manner.

As shown in FIG. 3 these steps produce a dipole potential across insulator 42 having a polarity and a sufficient magnitude to prevent negative ions produced by the negative corona from passing through the ion modulator in the areas of the modulator corresponding to the light areas of the image being reproduced. In the dark areas which are discharged the negative ions readily pass though the apertures of the ion modulator. Thus, in the areas of the ion modulator corresponding to the dark areas of the image being reproduced a negative charge will be impressed upon a dielectric surface placed in the ion path and in the areas of the modulator corresponding to the light areas of the image no negative charge upon the dielectric will result.

The modulators of this invention display memory capabilities up to about 100 times that of previously available modulators. If it is desired to erase such memory the modulator can be discharged by means of an AC corona and flooding light.

Another process operating in the positive mode is illustrated in FIG. 4. Ion modulator 50 includes metallic screen 51, insulator 52, and photoconductor 53. Screen 51 is connected to ground.

The process operates with the following sequence of steps:

Step A: simultaneously charging with a negative corona from the photoconductor side of the modulator and imaging.

Step B: applying an AC corona in the dark to discharge the dark areas of the modulator and to redistribute the positive charges between the outside surface of the photoconductor and the interface between the insulator and the screen in the light areas of the modulator.

Step C: applying a blanket light to discharge the photoconductor resulting in the production of a dipole potential across the insulator in the light areas.

Step D: projecting a negative corona from the screen side of the modulator.

As shown in FIG. 4 these steps produce a dipole potential having a polarity and a sufficient magnitude to prevent negative ions projected by the negative corona from passing through the modulator in areas corresponding to the light areas of the image being produced. In the dark areas there is no dipole potential opposing the passage of negative ions through the modulator apertures, so the ions which pass through the apertures impress a negative charge upon a dielectric surface interposed in their path. The net result is the production of a latent electrostatic image which can be developed by means of procedures known in the art.

Figure 5:
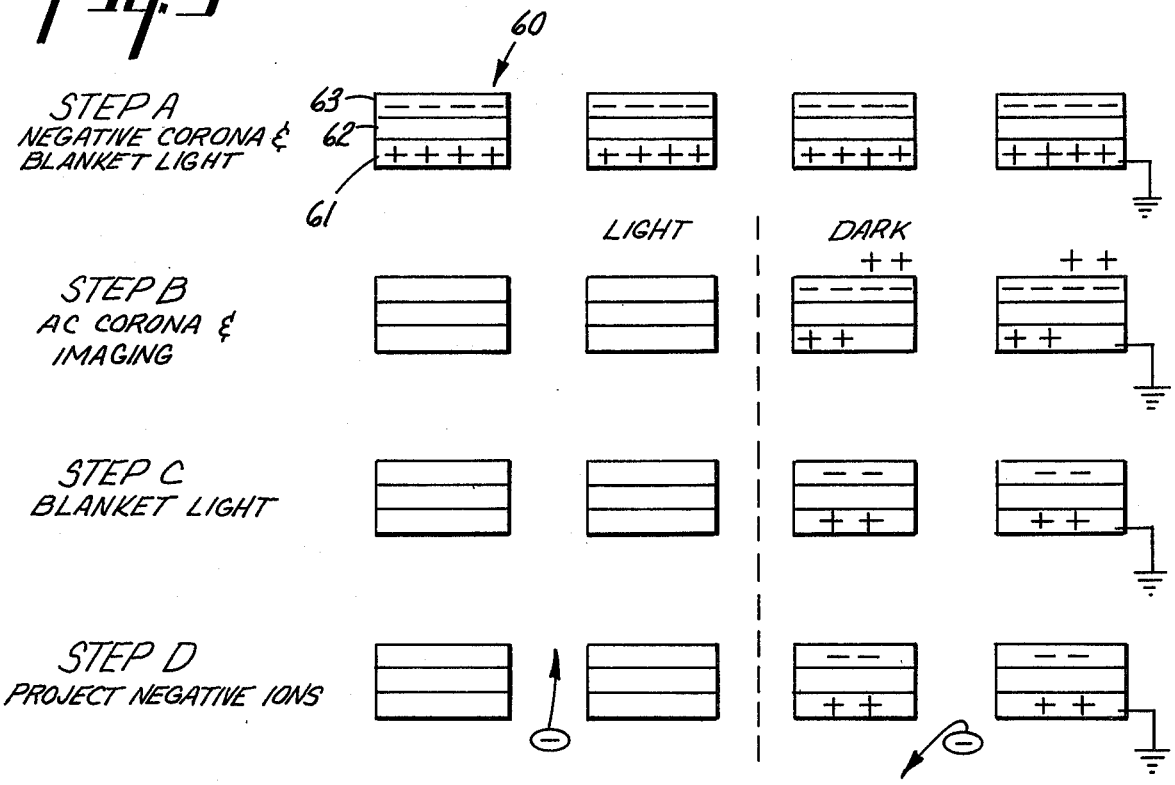
FIG. 5 is a diagrammatic view of another process.

FIG. 5 illustrates a process which operates in the negative mode in which negative image is produced from a positive copy.

Ion modulator 60 includes grounded screen 61, insulator 62, and photoconductor 63. The process steps involved in operating the ion modulator in a negative mode are as follows:

Step A: flooding the modulator with a blanket light while precharging with a negative corona from the photoconductor side of the modulator.

Step B: imaging while simultaneously applying an AC corona to discharge the light areas of the modulator and to redistribute the positive charges in the dark areas between the outside surface of the photoconductor and the interface between the insulator and screen.

Step C: flooding the modulator with a blanket light to discharge the photoconductor in the dark areas resulting in the production of a dipole potential across the insulator.

Step D: projecting a negative corona from the screen side of the modulator.

As shown in FIG. 5 these steps result in negative ions projected from the negative corona passing through apertures in the areas of the modulator corresponding to light areas in the original and being repelled from apertures in areas corresponding to dark areas in the original. The net result is a negative process, that is, one which can be used to produce negative copies from positive originals or vice versa.

The process illustrated in FIG. 6 operates in the positive mode. This is a preferred process for reasons which will be pointed out following a description thereof.

Ion modulator 70 includes grounded metallic screen 71, insulator 72 and photoconductor 73.

The steps of the process are as follows:

Step A: precharging with a negative corona from the photoconductor side of the modulator while flooding the modulator with a blanket light to produce a negative dipole potential across the insulator layer of the modulator.

Step B: simultaneously imaging and subjecting the modulator to an AC corona with a positive DC bias to produce a lesser positive potential across the insulator in the light areas and to redistribute the positive charge in the dark areas from the interface between the insulator and screen to the surface of the photoconductor. The magnitude of the positive dipole in the light areas and the extent to which the positive charges are redistributed in the dark areas may be controlled by the bias applied to the AC corona.

Step C: flooding the modulator with a blanket light to discharge the photoconductor in the dark areas of the modulator leaving a negative dipole potential across the insulator layer. The positive dipole in the light area is not affected by flooding light.

Step D: projective corona from the screen side of the modulator.

As shown in FIG. 6 these steps result in a dipole potential of a polarity to repel positive ions from the apertures in the areas of the modulator corresponding to light areas in the original to be reproduced that is, a positive dipole, and a dipole potential of a polarity to propel positive ions through the apertures in the areas of the modulator corresponding to dark areas in the original, that is, a negative dipole. The magnitude of the dipoles can be controlled by adjustment of the DC bias potential applied to the AC corona, since the biased AC potential results in current peaks during the part of the alternating current cycle having the same polarity as the bias potential which are greater than current peaks in the opposite part of the cycle by an amount determined by the bias potential. The magnitude of the dipoles can also be controlled by varying the exposure time, that is, the length of time during which the modulator is both imaged and subjected to AC corona.

Bias potentials may be widely varied depending upon the results desired but in general a bias of about from 1,000 volts to 10,000 volts can be used if an AC potential of 10,000 volts peak is used. The bias potential, which is DC can be either positive or negative in polarity but should be opposite to the polarity of the precharging corona. Depending upon the polarity of the corona used for projecting ions, then, a positive or negative image can be obtained.

The above described embodiment is preferred because its use results in the maximum electric field across the photoconductor during AC and light discharge and produces a relatively high modulator potential. These effects will be explained by reference to an ion transmission curve which is representative of the transmission of ions through the apertures of the modulator of this invention. Such a curve is shown in FIG. 7 which is a semilogarithmic plot of transmission coefficient against modulator or dipole potential. Increasing the modulator potential which, in the embodiment depicted in FIG. 6 is accomplished by means of biasing the AC corona, effectively moves the operation of the dark area of the modulator to the right along the curve into a region of higher ion transmission and to a part of the curve which is less steep while maintaining the light area of the modulator of a potential greater than the blocking potential, that is, the potential at which no ions are permitted to pass through the apertures of the ion modulator. Higher ion transmission means less projection time is required for a given corona or that, for a given projection time, a corona of smaller current generating capability can be used. Operation in the less steep regions of the curve, particularly in the first quadrant thereof, results in pagewise homogeneity since the variation in ion transmission is less pronounced for a given variation in modulator potential than in the steeper regions of the curve, for example in the second quadrant. Furthermore, the clean background is preserved, because the dipole potential in the light area of the modulator is greater than the blocking potential. Thus the embodiment of FIG. 6 has advantages which are realized to a lesser extent in the other embodiments of this invention, which nevertheless possess advantages as above described which are not obtainable using prior art techniques.

In general DC corona potentials range from about 4,000 volts to 12,000 volts and AC corona potentials range from about 3,000 volts to 14,000 volts peak. The potential applied to the high voltage plate is in the range of about from 4,000 volts to 10,000 volts DC.

The screen of the modulator has been described as connected to ground potential. However, a reference potential other than ground may be used if desired.

It should also be noted that similar results can be obtained using the ion modulators of this invention if the polarities described above are reversed. For example, in the case of the embodiment of FIG. 3 a positive corona can be used for charging the modulator and positive ions can be projected.

In the foregoing description of ion modulator processes reference has been made to light and dark areas corresponding to areas of light and shadow in the original being copied. It should be understood that these areas frequently shade into one another and that many images to be copied contain a variety of half-tones. Therefore the prevention of ion transmission is frequently only partial rather than complete and the ion modulators of this invention function to produce a latent electrostatic image which accurately reproduces the various degrees of light and shadow in the original.

Other embodiments may occur to those skilled in the art and it is therefore intended that this invention is not to be limited as defined in the following claims.

We claim:

1. A process for producing copies from an original comprising the steps of applying an electrostatic charge to a photoconductive surface of an apertured ion modulator, exposing said modulator to a pattern of light and shadow corresponding to said original, apply an alternating current to said modulator in the absence of a blanket light, flooding said modulator with a blanket light, projecting ions upon a conductive surface of said modulator opposite from said photoconductive surface whereby said ions are transmitted through said modulator in a pattern corresponding to said original, creating a latent electrostatic image corresponding to said pattern upon a dielectric surface in the path of said transmitted ions, and developing said latent electrostatic image, said modulator comprising a conductive apertured surface uniformly coated substantially only on one side with an insulator layer and overcoated with a photoconductor.

2. A process according to claim 1 wherein said electrostatic charge is applied by means of a direct current corona.

3. A process according to claim 2 wherein said corona is of negative polarity.

4. A process according to claim 2 wherein said corona is of positive polarity.

5. A process according to claim 1 wherein said alternating current is provided by means of a corona.

6. A process according to claim 5 wherein said corona is biased with a direct current potential of a polarity opposite to that of said electrostatic charge.

7. A process according to claim 6 wherein said direct current potential is of positive polarity.

8. A process according to claim 6 wherein said direct current potential is of negative polarity.

9. A process according to claim 1 wherein said ions are negative ions.

10. A process according to claim 1 wherein said ions are positive ions.

11. A process according to claim 1 wherein said ions are projected by means of a direct current corona.

12. A process according to claim 6 wherein said potential is of sufficient magnitude to cause said modulator to operate in the first and the second quadrants of the ion transmission curve characteristic of said modulator.

13. A process according to claim 1 wherein the effect of said flooding is the creation of dipole potentials across said insulator layer which selectively prevent the transmission of ions through said modulator in areas corresponding to areas of light in said original and selectively permit the transmission of ions through said modulator in areas corresponding to areas of shadow in said original.

14. A process according to claim 1 wherein the effect of said flooding is the creation of dipole potentials across said insulator layer which selectively prevent the transmission of ions through said modulator in areas corresponding to areas of shadow in said original, and selectively permit the transmission of ions through said modulator in areas corresponding to areas of light in said original.

15. A process according to claim 1 wherein the effect of said flooding is the creation of dipole potentials across said insulator layer, said dipole potentials being of one polarity in areas corresponding to areas of light in said original and of the opposite polarity in areas corresponding to areas of shadow in said original.

16. A process according to claim 1 wherein the copies produced are positive copies.

17. A process according to claim 1 wherein the copies produced are negative copies.

18. A process according to claim 1 which includes the following sequence of steps:

1. charging with a direct current corona of negative polarity,
2. imaging,
3. applying an alternating current corona,
4. flooding with light, and
5. projecting negative ions.

19. A process according to claim 1 which includes the following sequence of steps: j 1. charging with a direct current corona of negative polarity while simultaneously imaging,
2. applying an alternating current corona,
3. flooding with light, and
4. projecting negative ions.

20. A process according to claim 1 which includes the following sequence of steps:

1. charging with a direct current corona of negative polarity while simultaneously flooding with light,
2. imaging while simultaneously applying an alternating current corona,
3. flooding with light, and
4. projecting negative ions.

21. A process according to claim 1 which includes the following sequence of steps:

1. charging with a direct current corona of negative polarity while simultaneously flooding with light,
2. imaging while simultaneously applying an alternating current corona with a direct current bias potential of positive polarity,
3. flooding with light, and
4. projecting positive ions.

* * * * *

UNITED STATES PATENT OFFICE

CERTIFICATE OF CORRECTION

PATENT NO. : 3,970,452

DATED : July 20, 1976

INVENTOR(S) : Alexander Chiang-Hsia Wu et al.

It is certified that error appears in the above-identified patent and that said Letters Patent are hereby corrected as shown below:

Column 3, line 6, "on" should read -- or --.

Signed and Sealed this

First Day of February 1977

[SEAL]

*Attest:*

RUTH C. MASON
*Attesting Officer*

C. MARSHALL DANN
*Commissioner of Patents and Trademarks*